US006688721B1

(12) United States Patent
Serra

(10) Patent No.: US 6,688,721 B1
(45) Date of Patent: Feb. 10, 2004

(54) MISALIGNMENT REDUCTION OF STATIONARY FLUID EJECTOR ASSEMBLIES ALONG AXIS ALONG WHICH MEDIA MOVES

(75) Inventor: Josep-Maria Serra, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/211,510

(22) Filed: Aug. 2, 2002

(51) Int. Cl.[7] ..... B41J 29/393; B41J 2/145; B41J 2/15

(52) U.S. Cl. ..... 347/19; 347/40

(58) Field of Search ..... 347/9, 10, 14, 347/19, 37, 12, 40, 42

(56) References Cited

U.S. PATENT DOCUMENTS

| | | | | |
|---|---|---|---|---|
| 5,241,325 | A | 8/1993 | Nguyen | 347/40 |
| 5,428,375 | A | 6/1995 | Simon et al. | 347/12 |
| 6,213,580 | B1 | 4/2001 | Segerstrom et al. | 347/19 |
| 6,422,678 | B1 * | 7/2002 | Serra et al. | 347/19 |

* cited by examiner

*Primary Examiner*—Juanita Stephens

(57) ABSTRACT

A method of one embodiment of the invention is disclosed that reduces misalignment of a pair of stationary fluid ejector assemblies positioned along a first axis perpendicular to a second axis along which media moves past the assemblies. The method reduces misalignment of the pair of stationary fluid ejector assemblies along the second axis. First fluid lines are output at a first period by one of the assemblies, and second fluid lines are output at a second period greater than the first period by another of the assemblies. A fluid ejection delay of at least one of the assemblies is adjusted based on which of the second fluid lines is substantially aligned with which of the first fluid lines along the second axis.

20 Claims, 13 Drawing Sheets

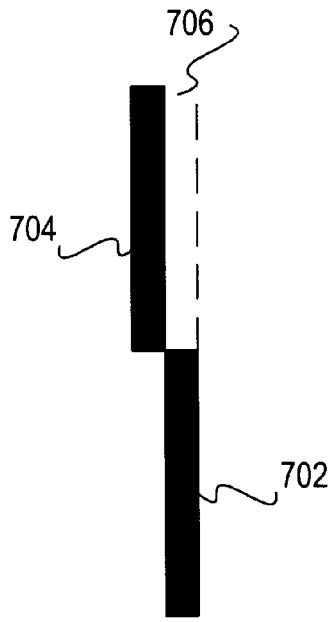
FIG 7A
FIG 7B
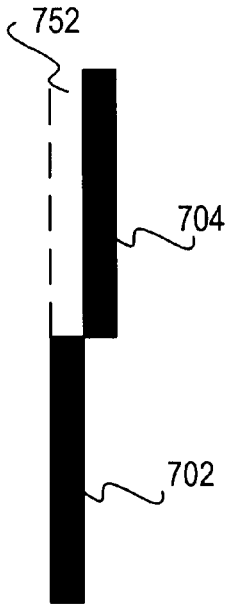

800
802
SELECT K SO THAT K...K+L REPRESENTS CENTER NOZZLES
804
M = K
PRINT GRAY BAND WITH $N_0$ WITH NOZZLES K...K+L, AND WITH $N_1$ WITH NOZZLES M...M+L
806
808
ALIGNED?
YES
810
DONE
NO
814
M=M+1
YES
OVERLAP?
NO
820
M=M-1
812
M+L > LAST NOZZLE OF $N_1$?
NO
816
YES
K=K-1
M=M-1
818
822
M< FIRST NOZZLE OF $N_1$?
NO
YES
824
K=K+1
M=M+1

MISALIGNMENT REDUCTION OF STATIONARY FLUID EJECTOR ASSEMBLIES ALONG AXIS ALONG WHICH MEDIA MOVES

BACKGROUND

Inkjet printers generally operate by ejecting ink onto media, such as paper. One type of inkjet printer utilizes stationary staggered inkjet pens, which are also more generally referred to as fluid ejector assemblies. The inkjet pens are immobile, and are arranged in a staggered fashion over one axis referred to as the inkjet pen axis. Media is moved past the assemblies along another axis, referred to as the media axis, which is perpendicular to the inkjet pen axis. As the media moves past the inkjet pens, the pens accordingly eject ink onto the media. This type of inkjet printer is customarily, but not necessarily, used in industrial settings that require fast printing performance.

The inkjet pens can be or become misaligned in two ways. Along the inkjet pen axis, the inkjet pens may not be aligned correctly, leading to gaps between output from adjacent pens, or leading to overlapping output from adjacent pens. Along the media axis, too, the inkjet pens may not be aligned correctly. Because the pens are staggered, such misalignment may result from the fluid ejection delays of the inkjet pens not being properly set with respect to one another. An inkjet pen may thus begin outputting ink too soon or too late, resulting in misalignment along the media axis.

SUMMARY OF THE INVENTION

A method of one embodiment of the invention reduces misalignment of a pair of stationary fluid ejector assemblies positioned along a first axis perpendicular to a second axis along which media moves past the assemblies. The method reduces misalignment of the pair of stationary fluid ejector assemblies along the second axis. First fluid lines are output at a first period by one of the assemblies, and second fluid lines are output at a second period greater than the first period by another of the assemblies. A fluid ejection delay of at least one of the assemblies is adjusted based on which of the second fluid lines is substantially aligned with which of the first fluid lines along the second axis.

BRIEF DESCRIPTION OF THE DRAWINGS

The drawings referenced herein form a part of the specification. Features shown in the drawings are meant as illustrative of only some embodiments of the invention, and not of all embodiments of the invention, unless otherwise explicitly indicated, and implications to the contrary are otherwise not to be made.

FIGS. 7A and 7B are diagrams illustrating examples of different types of misalignment of a pair of inkjet pens along the media axis, according to differing embodiments of the invention.

DETAILED DESCRIPTION OF THE DRAWINGS

In the following detailed description of exemplary embodiments of the invention, reference is made to the accompanying drawings that form a part hereof, and in which is shown by way of illustration how specific embodiments of the invention may be practiced. These embodiments are described in sufficient detail to enable those skilled in the art to practice them. Other embodiments may be utilized, and logical, mechanical, and other changes may be made without departing from the spirit or scope of the present invention. For example, whereas an embodiment of the invention is partially described in relation to an inkjet printer dispensing ink, it is more broadly applicable to other kinds of fluid ejection systems. The following detailed description is, therefore, not to be taken in a limiting sense, and the scope of the invention is defined only by the appended claims.

Overview

Figure 1:
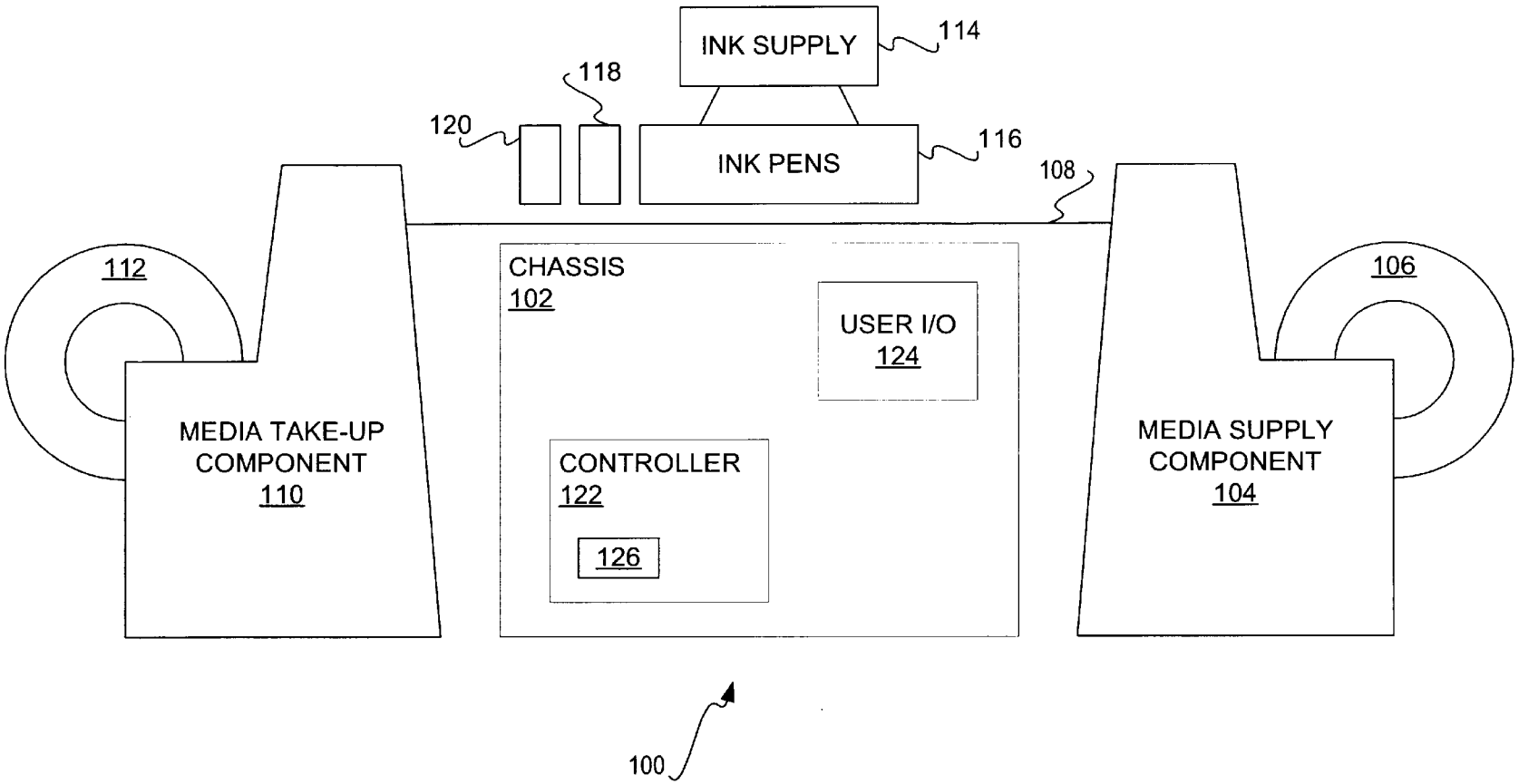
FIG. 1 is a diagram of the side view of an inkjet printer, according to an embodiment of the invention.

FIG. 1 shows the side view of a printer 100 according to an embodiment of the invention. Media 108, such as paper, is supplied by a media supply component 104 from a media supply roll 106. The media 108 is moved over a chassis 102 of the printer 100, and then is taken up by a media take-up component 110 to a media take-up roll 112. While the media 108 moves over the chassis 102, stationary inkjet pens 116 eject ink onto the media 108. An ink supply 114 provides ink to the inkjet pens 116. A heater 118 may optionally be included as part of the printer 100 to dry the ink being ejected from the inkjet pens 116 after the ink is dispensed onto the medium 108. More generally, the ink is fluid, and the pens 116 are fluid ejector assemblies.

The chassis 102 includes a controller 122 that controls movement of the media 108 from the media supply component 104 to the media take-up component 110, and controls ejection of ink from the inkjet pens 116. The controller 122 includes a component 126 that at least partially aligns the inkjet pens 116. Alternatively, the component 126 may be separate from the controller 122. The controller 122 and the component 126 may each be a combination of software and/or hardware. The component 126 may provide for automatic alignment of the inkjet pens 116, without user intervention, and/or manual alignment of the inkjet pens 116, with user intervention. The component 126 may be considered the means for performing its respective functionality.

For automatic alignment of the inkjet pens 116, a sensor 120 is optionally included as part of the printer 100 to detect the ink output by the inkjet pens 116 on the media 108. More specifically, the sensor 120 detects the position of the ink output by the inkjet pens 116 on the media 108, to determine whether the inkjet pens 116 are aligned with one another. By interacting with the sensor 120, the component 126 realigns the inkjet pens 116 when they are misaligned.

For manual alignment of the inkjet pens 116, a user input/output (I/O) 124 is optionally included as part of the printer 100. The user I/O 124 includes a display mechanism to display information to the user, and a user input mechanism to receive information from the user. The user examines the output by the inkjet pens 116 on the media 108, and if the user determines that the inkjet pens 116 are misaligned, interacts with the component 126 via the user I/O 124 to realign the inkjet pens 116.

Figure 2:
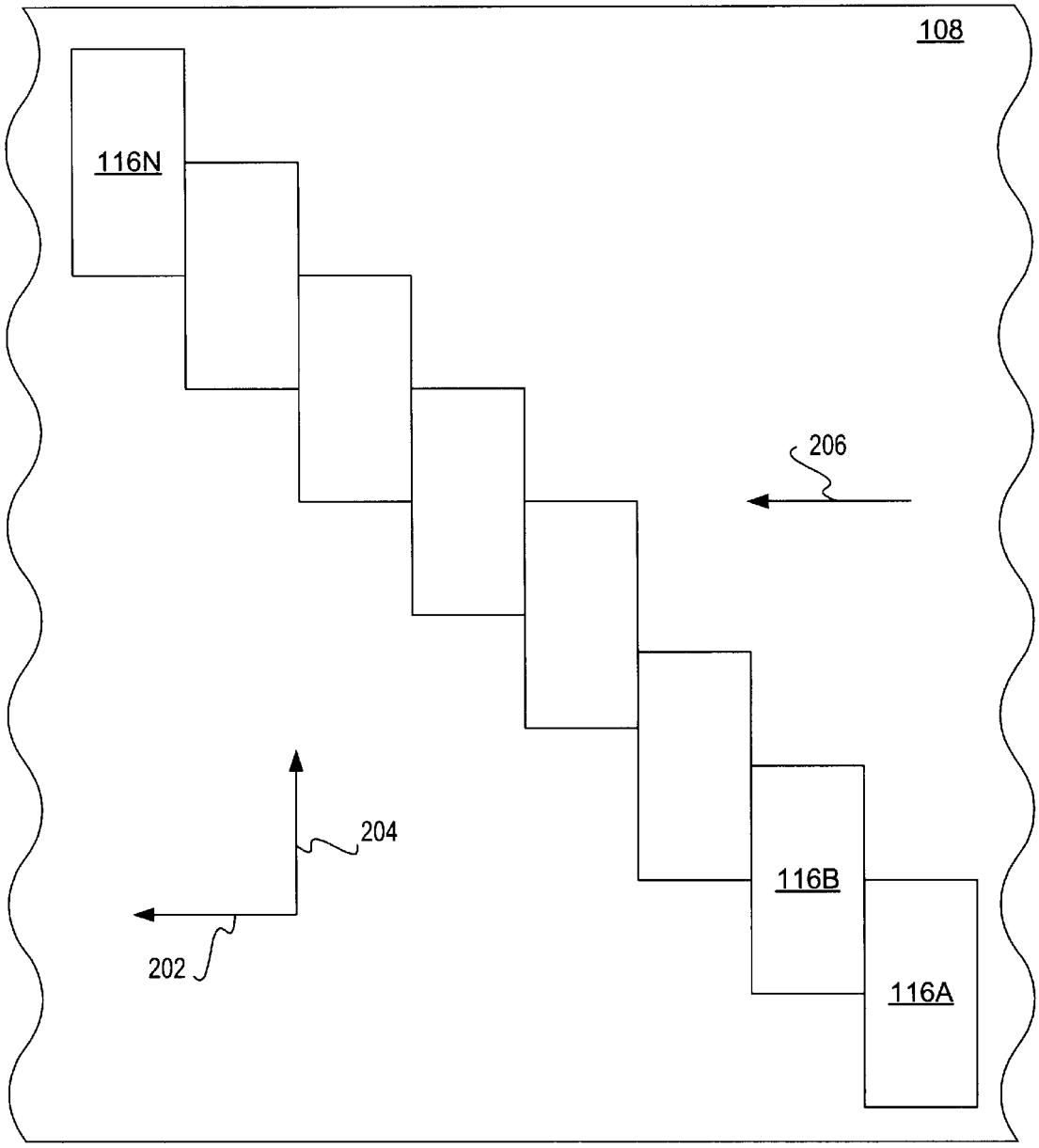
FIG. 2 is a diagram of the top view of the inkjet pens of an inkjet printer under which media moves past, according to an embodiment of the invention.

FIG. 2 shows the top view of the inkjet pens 116 over the media 108 in detail, according to an embodiment of the invention. The inkjet pens 116 includes the inkjet pens 116A, 116B, . . . 116N. The inkjet pens 116 are positioned in a stationary and/or staggered formation over the media 108 that moves past and under the pens 116 from right to left, as indicated by the arrow 206. The inkjet pens 116 as shown in FIG. 2 constitute one set of inkjet pens staggered from right to left. Alternatively, additional set(s) of stationary staggered inkjet pens may be included. In addition, two axes 202 and 204 are identified in FIG. 2. The media axis 202 is the axis along which the media 108 travels, in the direction identified by the arrow 206. The inkjet pen axis 204 is the axis along which the inkjet pens 116 are positioned in a staggered fashion.

Figure 3:
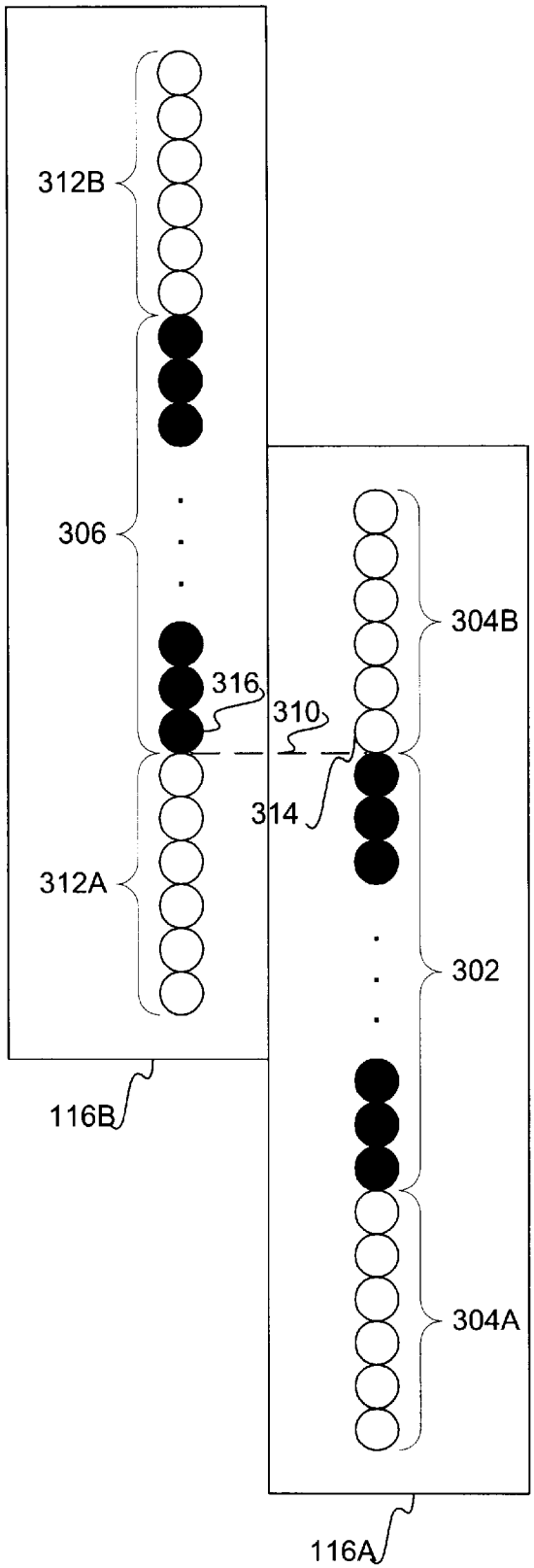
FIG. 3 is a diagram of the top view of a pair of inkjet pens of an inkjet printer and their corresponding nozzles, according to an embodiment of the invention.

FIG. 3 shows the top view of the pair of inkjet pens 116A and 116B in detail, according to an embodiment of the invention. The inkjet pen 116A includes a number of nozzles. The nozzles are divided into a series of active nozzles 302, and inactive nozzles 304A and 304B above and below, respectively, the series of active nozzles 302. Ink is actually dispensed from the series of active nozzles 302. The inactive nozzles 304A and 304B do not normally dispense ink. They are present for aligning the inkjet pen 116A relative to the inkjet pen 116B along the pen axis 204, as will be described.

Similarly, the inkjet pen 116B includes a series of active nozzles 306, and inactive nozzles 312A and 312B above and below, respectively, the series of active nozzles 306. In one embodiment, there can be 512 active nozzles within each of the series 302 and 306, and there are a total of twelve inactive nozzles between the inactive nozzles 304A and 304B, and between the inactive nozzles 312A and 312B. In other embodiments, there can be more or less than 512 active nozzles and more or less than a total of twelve inactive nozzles. Furthermore, preferably the last active nozzle 314 of the series 302 of the inkjet pen 116A is aligned with the first active nozzle 316 of the series 306 of the inkjet pen 116B, as indicated by the dotted line 310.

Alignment and Misalignment of Inkjet Pens Along the Pen and Media Axes

Figure 4A:
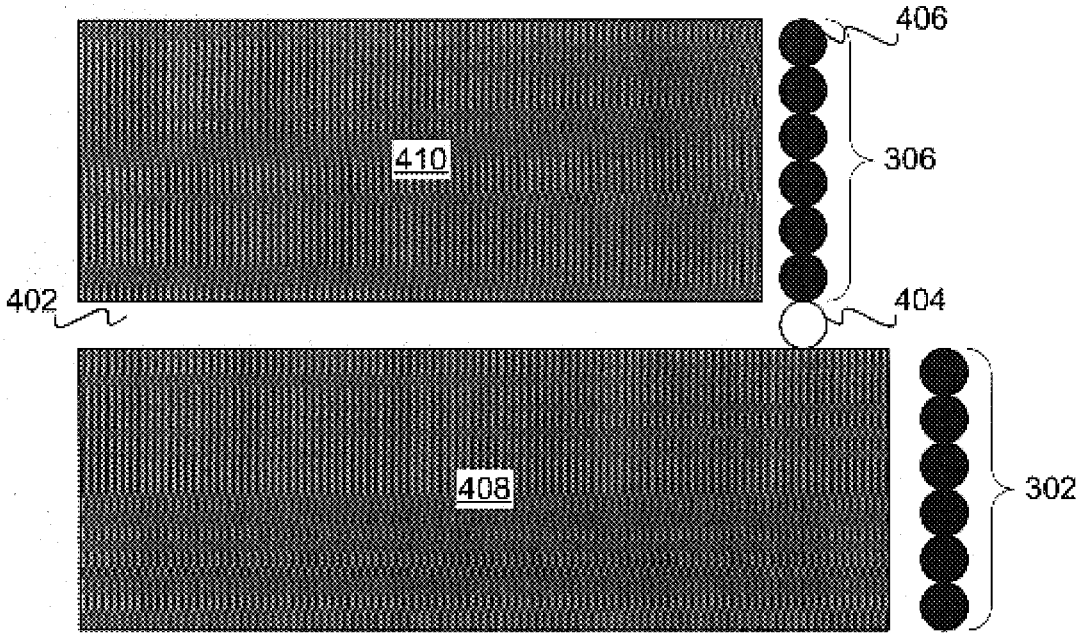
FIGS. 4A and 4B are diagrams illustrating an example of one type of misalignment of a pair of inkjet pens along the inkjet pen axis, and the correction of such misalignment, according to an embodiment of the invention.
Figure 4B:
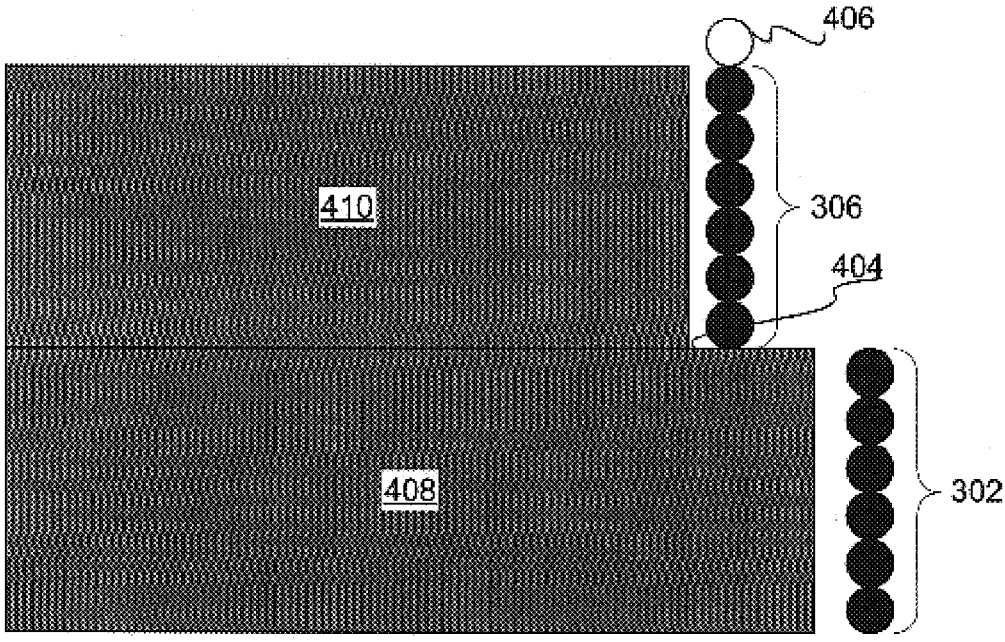

FIGS. 4A and 4B show an example of one type of misalignment of the inkjet pens 116A and 116B along the pen axis 204, and the correction of this misalignment, according to an embodiment of the invention. The inkjet pens 116 and 116B of FIGS. 4A and 4B are staggered, and may also be stationary.

In FIG. 4A, the series of active nozzles 302 of the inkjet pen 116A prints the ink band 408, whereas the series of active nozzles 306 of the inkjet pen 116B prints the ink band 410. However, the inkjet pens 116A and 116B are misaligned along the pen axis 204, resulting in a gap 402 between the ink bands 408 and 410 printed by the series of active nozzles 302 and 306. Particularly shown in FIG. 4A is that there is an inactive nozzle 404 immediately adjacent to the active nozzle 316 of the inkjet pen 116B, and that the last active nozzle of the series of active nozzles 306 is the nozzle 406.

In FIG. 4B, the inkjet pens 116A and 116B are now aligned along the pen axis 204. Thus, the ink band 408 printed by the series of active nozzles 302 of the inkjet pen 116A aligns with the ink band 410 printed by the series of active nozzles 306 of the inkjet pen 116B, without any intervening gaps, such as the gap 402 of FIG. 4A. The alignment along the pen axis 204 is accomplished by shifting the series of active nozzles 306 down by one nozzle. As a result, the series of active nozzles 306 includes the nozzle 404 in FIG. 4B, which was previously inactive in FIG. 4A. Furthermore, the nozzle 406 is inactive in FIG. 4B, whereas it was part of the series of active nozzles 306 in FIG. 4A.

Figure 5A:
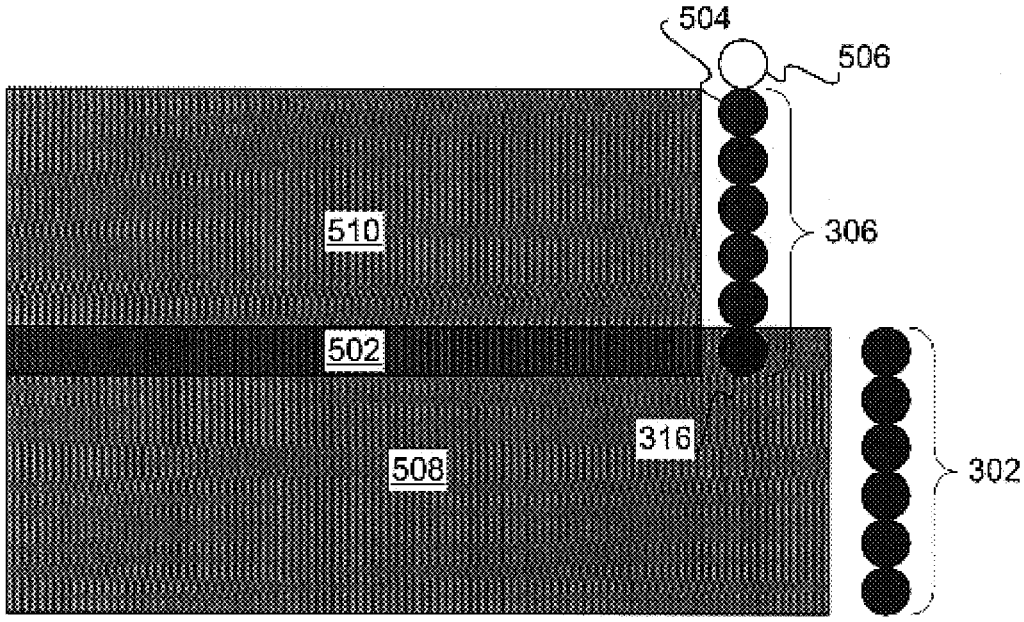
FIGS. 5A and 5B are diagrams illustrating an example of another type of misalignment of a pair of inkjet pens along the inkjet pen axis, and the correction of such misalignment, according to an embodiment of the invention.
Figure 5B:
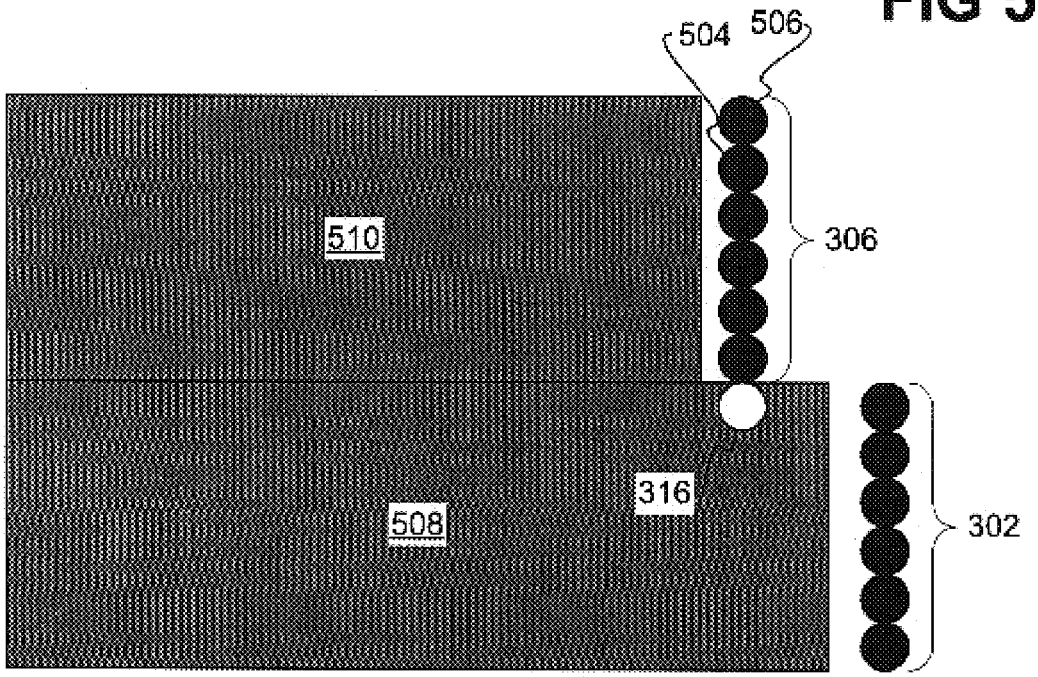

FIGS. 5A and 5B show an example of another type of misalignment of the inkjet pens 116A and 116B along the pen axis 204, and the correction of this misalignment, according to an embodiment of the invention. The inkjet pens 116A and 116B of FIGS. 5A and 5B are staggered, and may also be stationary. In FIG. 5A, the series of active nozzles 302 of the inkjet pen 116A prints the ink band 508, whereas the series of active nozzles 306 of the inkjet pen 116B prints the ink band 510. However, the inkjet pens 116A and 116B are misaligned along the pen axis 204, resulting in an area of overlap 502 between the ink bands 508 and 510 printed by the series of active nozzles 302 and 306. Particularly shown in FIG. 5A is that there is an inactive nozzle 506 immediately adjacent to the active nozzle 504 of the inkjet pen 116B, and that the first active nozzle of the series of active nozzles 306 is the nozzle 316.

In FIG. 5B, the inkjet pens 116A and 116B are now aligned along the pen axis 204. Thus, the ink band 508 printed by the series of active nozzles 302 of the inkjet pen 116A aligns with the ink band 510 printed by the series of active nozzles 306 of the inkjet pen 116B, without any areas of overlap, such as the area of overlap 502 of FIG. 5A. The alignment along the pen axis 204 is accomplished by shifting the series of active nozzles 306 up by one nozzle. As a result, the series of active nozzles 306 includes the nozzle 506 in FIG. 5B, which was previously inactive in FIG. 5A. Furthermore, the nozzle 316 is inactive in FIG. 5B, whereas it was part of the series of active nozzles 306 in FIG. 5A.

The inkjet pen misalignment along the inkjet pen axis 204 in FIGS. 4A and 5A that is corrected in FIGS. 4B and 5B, respectively, is a one pixel-in-height misalignment, where the height of the output by a nozzle of an inkjet pen corresponds to one pixel. As can be appreciated by those of ordinary skill within the art, inkjet pens can become misaligned by more than one pixel in height as well. In such instances, the series of active nozzles of one of the pens can be adjusted by the number of nozzles corresponding to the number of pixels in height of the misalignment.

Figure 6A:
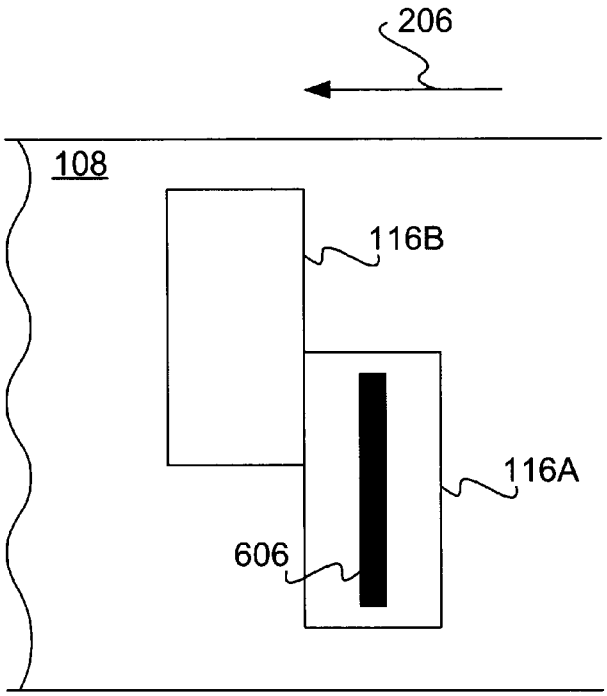
FIGS. 6A and 6B are diagrams illustrating the alignment of a pair of inkjet pens along the media axis, according to an embodiment of the invention.
Figure 6B:
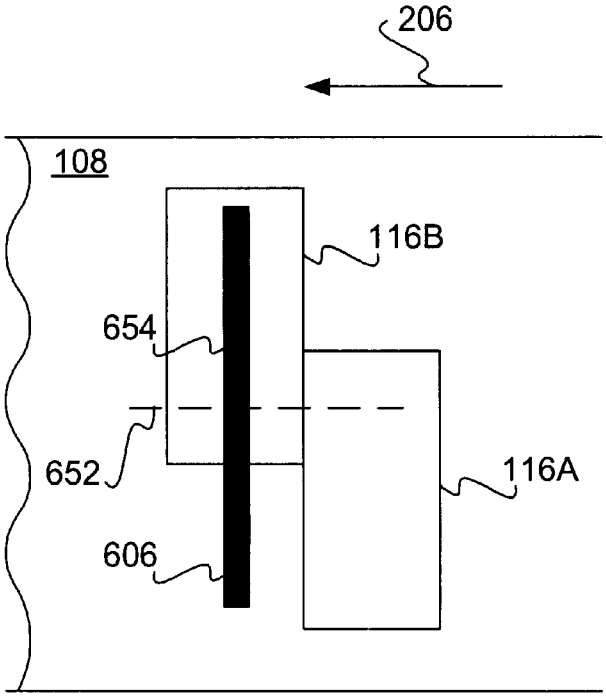

FIGS. 6A and 6B show alignment of the inkjet pens 116A and 116B along the media axis 202, according to an embodiment of the invention. The inkjet pens 116A and 116B are shown in FIGS. 6A and 6B as staggered. However, these pens are at least stationary, and may also be staggered as shown in FIGS. 6A and 6B. In FIG. 6A, the media 108 is moving from right to left, as indicated by the arrow 206. The inkjet pen 116A has printed a one pixel-in-width ink line 606. The media 108 continues to move from right to left, such that in FIG. 6B, when the ink line 606 printed by the inkjet pen 116A is aligned with the inkjet pen 116B, the inkjet pen 116B prints a one pixel-in-width ink line 654. For illustrative clarity, the dotted line 652 separates the ink line 654 from the ink line 606. The inkjet pens 116A and 116B are aligned along the media axis 202, resulting in the ink lines 606 and 654 they output themselves being aligned.

The inkjet pens 116A and 116B are aligned relative to one another by proper calibration of their respective fluid ejection delays. In particular, once the inkjet pen 116A has output the line 606 in FIG. 6A, the inkjet pen 116B delays a length of time, commensurate with the speed of the media 108 as it moves from right to left, before it outputs the line 654. If the relative fluid ejection delay between the two inkjet pens 116A and 116B are not aligned with one another, then the inkjet pen 116B will not output the line 654 directly in line with the line 606 output by the inkjet pen 116A.

FIGS. 7A and 7B show examples of the different types of misalignment of the inkjet pens 116A and 116B along the media axis 202, according to different embodiments of the invention. The inkjet pens 116A and 116B are shown in FIGS. 7A and 7B as staggered. However, these pens are at least stationary, and may also be staggered as shown in FIGS. 7A and 7B. In FIG. 7A, the fluid ejection delay of the inkjet pen 116B is too great. After the inkjet pen 116A has printed the ink line 702, the inkjet pen 116B waits too long before printing the ink line 704, resulting in a gap 706. The ink line 704, in other words, is printed too late. To correct this misalignment, the fluid ejection delay of the inkjet pen 116B is decreased commensurate with the speed at which the media 108 travels the width of the gap 706.

Conversely, in FIG. 7B, the fluid ejection delay of the inkjet pen 116B is too small. After the inkjet pen 116A has printed the ink line 702, the inkjet pen 116B does not wait long enough before printing the ink line 704, resulting in a gap 752. The ink line 704, in other words, is printed too soon. To correct this misalignment, the fluid ejection delay of the inkjet pen 116B is increased commensurate with the speed at which the media 108 travels the width of the gap 752.

The inkjet pen misalignment along the media axis 202 in FIGS. 7A and 7B is a one pixel-in-width misalignment, where the width of the output by a nozzle of an inkjet pen corresponds to one pixel. As can be appreciated by those of ordinary skill within the art, inkjet pens can become misaligned by more than one pixel in width as well. In such instances, the fluid ejection delays of the pens can be adjusted commensurate with the speed at which the media 108 travels the number of pixels in width of the misalignment.

Correcting Misalignment of Inkjet Pens Along the Inkjet Pen Axis

Figure 8:
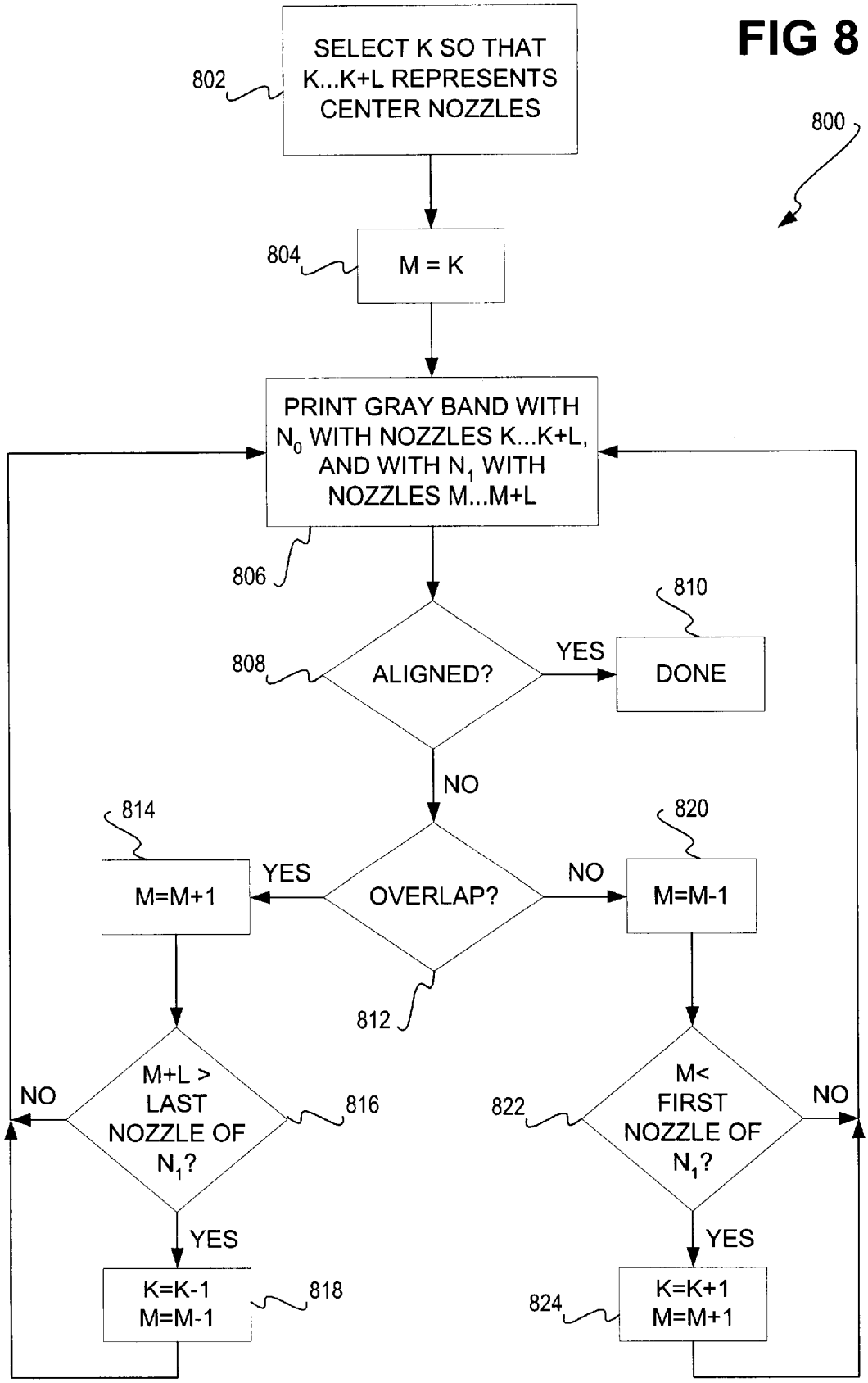
FIG. 8 is a flowchart of a method for correcting misalignment between a pair of inkjet pens along the inkjet pen axis, according to an embodiment of the invention.

FIG. 8 shows a method 800 for correcting the misalignment between a pair of inkjet pens along the inkjet pen axis, according to an embodiment of the invention. Misalignment between pens along the inkjet pen axis is generally defined herein as misalignment of the output of the pens along this axis, as can be appreciated by those of ordinary skill within the art. Of the number of inkjet nozzles within each of a first inkjet pen $n_0$ and a second inkjet pen $n_1$ of the pair of inkjet pens, a contiguous l of them are used as the series of active nozzles. The method 800 shifts the series of active nozzles of the second pen of the pair so that the second pen is aligned with the first pen. The method 800 effectively performs the misalignment correction described in conjunction with and displayed in FIGS. 4A and 4B, and FIGS. 5A and 5B, and reference can be made thereto for an illustrative explanation as to the correction performed by the method 800. Furthermore, like other methods of embodiments of the invention, the method 800 can be implemented as a computer program storable on a computer-readable medium.

A value k is first selected so that the center range of nozzles k . . . k+l within either of the inkjet pen represents the current series of active nozzles (802). Next, the value m is set equal to k (804). A gray ink band is printed with the nozzles k . . . k+l of the inkjet pen $n_0$, and with the nozzles m . . . m+l of the inkjet pen $n_1$ (806). The gray band is more generally an ink band printed with less than maximum intensity by the nozzles of the inkjet pen. The two bands printed by the two inkjet pens allow for detection of gaps and overlap between the bands, indicative of misalignment between the two pens. For instance, a gap between the bands is displayed as a lack of ink, whereas an overlap between the bands is displayed as a greater intensity of ink than that at which either band is individually printed.

The bands are examined for alignment (808). For automatic alignment correction of the two inkjet pens, a sensor may determine whether a gap or an area of overlap is present between the two bands printed by the two inkjet pens. For manual alignment correction, the user determines whether a gap or an area of overlap exists between the two bands. If the no gap and no area of overlap are present, then the two inkjet pens are aligned with one another, and the method 800 is finished (810). In other embodiments of the invention, the gap is at least substantially reduced, but may not be totally eliminated.

Otherwise, if there is overlap between the bands (812), then the value m is incremented (814). Increasing m by one effectively shifts the active series of nozzles of the second inkjet pen $n_1$ up, away from the active series of nozzles of the first inkjet pen $n_0$. That is, the series of active nozzles of the second inkjet pen is adjusted so that ink output thereby is farther away from the ink output of the first inkjet pen. This shifting of the series of active nozzles of the second pen is more specifically accomplished by adding a nozzle to the series, and removing another nozzle from the series. The nozzle added to the series of nozzles of the second pen is the inactive nozzle adjacent to the end of this series farthest away from the series of active nozzles of the first pen. The nozzle removed from the series of nozzles of the second pen is the nozzle of this series closest to the series of active nozzles of the first pen.

Next, verification is performed as to whether the series of active nozzles of the second inkjet pen $n_1$ was not shifted past the last nozzle of this pen (816). That is, verification is performed to ensure that m+l is not greater than the last nozzle of the second inkjet pen $n_1$. If not, then the method 800 repeats 806, et seq., as has been described, to determine whether the adjustment performed results in alignment of the inkjet pens. However, if the verification fails, then the method 800 shifts the starting nozzle of the series of active nozzles of each of the pens $n_0$ and $n_1$ down by one nozzle (818), such that both series of active nozzles are shifted down, so that the series of active nozzles of the second pen $n_1$ is no longer shifted past its last nozzle. That is, the value k is decremented, as is the value m. The method 800 then repeats 806, et seq., as has been described.

However, if the type of misalignment between the bands output by the inkjet pens does not result in overlap (812), then the value m is instead decremented (820), because the type of misalignment instead results in a gap between the bands. Decreasing m by one effectively shifts the active series of nozzles of the second inkjet pen $n_1$ down, towards the active series of nozzles of the first inkjet pen $n_0$. That is, the series of active nozzles of the second inkjet pen is adjusted so that ink output thereby is closer to the ink output of the first inkjet pen. This shifting of the series of active nozzles of the second pen is more specifically accomplished by adding a nozzle to the series, and removing another nozzle from the series. The nozzle added to the series of nozzles of the second pen is the inactive nozzle adjacent to the end of this series to the series of active nozzles of the first pen. The nozzle removed from the series of nozzles of the second pen is the nozzle of this series farthest from the series of active nozzles of the first pen.

Next, verification is performed as to whether the series of active nozzles of the second inkjet pen $n_1$ was not shifted past, or before, the first nozzle of this pen (822). That is, verification is performed to ensure that m is not less than the first nozzle of the second inkjet pen $n_1$. If not, then the method 800 repeats 806, et seq., as has been described, to determine whether the adjustment performed results in alignment of the ink pens. However, if the verification fails, then the method 800 shifts the starting nozzle of the series of active nozzles of the pens $n_0$ and $n_1$ up by one nozzle (824), such that both series of active nozzles are shifted up, so that the series of active nozzles of the second pen $n_1$ is no longer shifted before its first nozzle. That is, the value k is incremented, as is the value m. The method 800 then repeats 806, et seq., as has been described.

Other embodiments to the method 800 can also be utilized. For instance, whereas the method 800 describes repeatedly selecting active nozzles, printing ink bands, and determining whether the bands are in alignment, until the bands are in alignment, in another embodiment a number of ink bands can be printed by each pen, using different nozzles of each pen. Determining which of the ink bands of the first inkjet pen matches, or is aligned with, which of the ink bands of the second inkjet pen thus determines which of the nozzles of each pen should be used as the active series of nozzles so that the pens are aligned along the inkjet pen axis.

Figure 9:
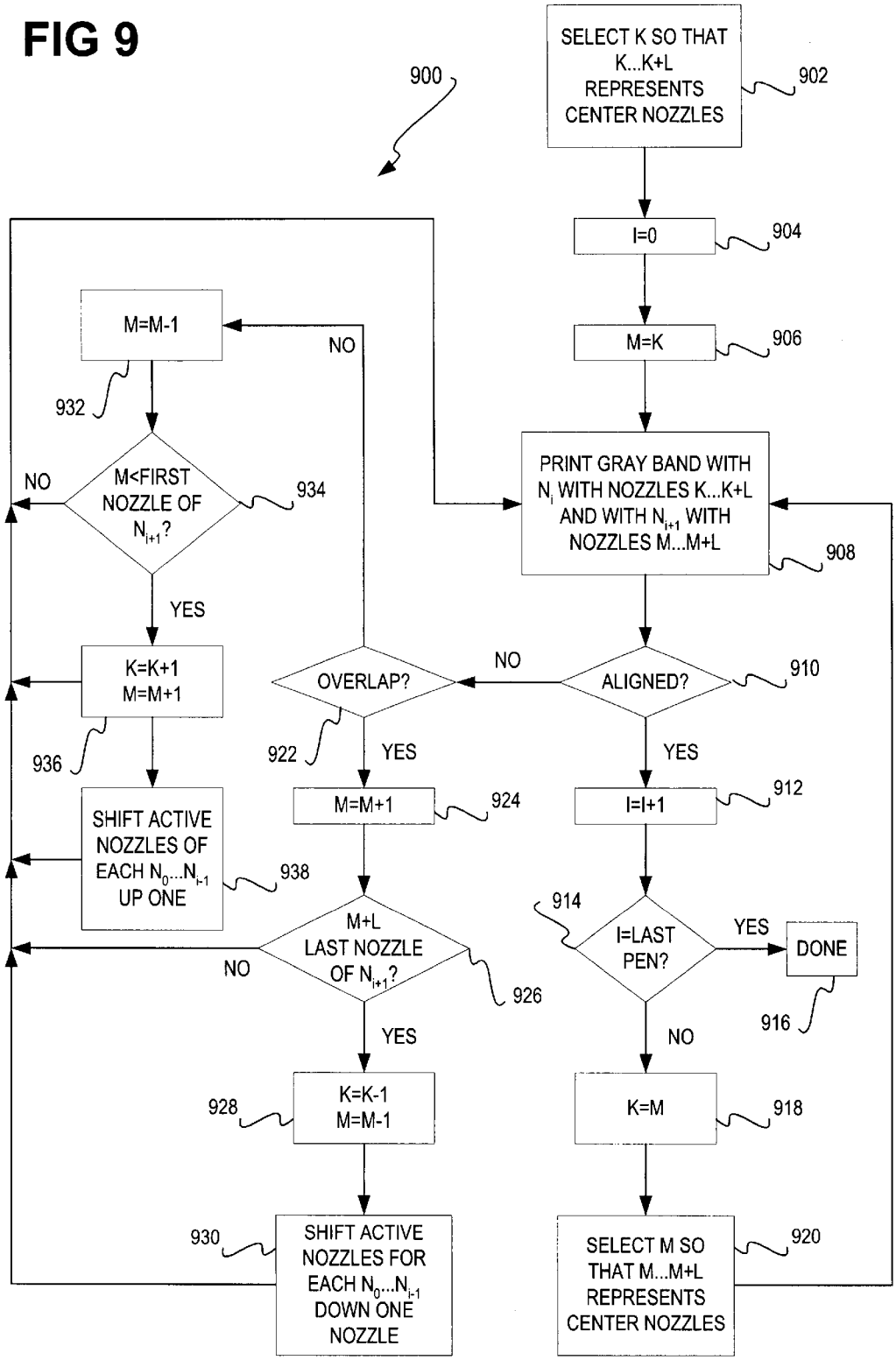
FIG. 9 is a flowchart of a method for correcting misalignment among a number of inkjet pens along the inkjet pen axis, according to an embodiment of the invention.

The method 800 can be extended to correct the misalignment along the inkjet pen axis between each successive rolling pair of inkjet pens of a number of inkjet pens. FIG. 9 shows such a method 900 for correcting misalignment among a number of inkjet pens along the inkjet pen axis, according to an embodiment of the invention. For each successive rolling pair of inkjet pens, the method 900 shifts the series of active nozzles of the second pen of the pair so that the second pen is aligned with the first pen of the pair.

A value k is first selected so that the center range of nozzles k . . . k+l within an inkjet pen represents the current series of active nozzles (902). Next, an inkjet pen counter i is reset to zero (904), and the value m is set equal to k (906). A current rolling pair of the inkjet pens is defined as the pens $n_i$ and $n_{i+1}$, where the first pen of the rolling pair is $n_i$ and the second pen is $n_{i+1}$. A gray ink band is printed with the nozzles k . . . k+l of the inkjet pen $n_i$ and with the nozzles m . . . m+l of the inkjet pen $n_{i+1}$ (908). The bands are manually or automatically examined for alignment (910). If no gap and no area of overlap between the bands exists, then the current rolling pair of pens are aligned with one another, and the current rolling pair of pens is advanced by one pen within the inkjet pens (912). That is, the counter i is incremented by one.

If the counter i is equal to the last inkjet pen (914), then the method 900 is finished (916). Otherwise, the value k is set to the value m (918). The value m is the starting nozzle within the range of nozzles for the second pen of the rolling pair of pens, whereas the value k is the starting nozzle within the range of nozzles for the first pen of the rolling pair of pens. Because the rolling pair of pens has been advanced by one pen, the first pen of the current rolling pair is the second pen of the previous rolling pair. Therefore, the starting nozzle m that was determined for the second pen of the previous rolling pen is now to be the starting nozzle k for the first pen of the current rolling pair. The value m is then set so that the center nozzles m . . . m+l represents the active series of pens for the second pen of the current rolling pair (920), and the method 900 repeats at 908, et seq., as has been described, to align the newly current rolling pair of inkjet pens.

If the current rolling pair of inkjet pens are misaligned (910), however, and if the misalignment results in the two bands output by the pens overlapping (922), then the value m is incremented (924), shifting the active series of nozzles of the second inkjet pen $n_{i+1}$ up, away from the active series of nozzles of the first inkjet pen $n_i$. Verification is performed as to whether the series of active nozzles of the second inkjet pen $n_{i+1}$ was not shifted past the last nozzle of this pen (926). That is, verification is performed to ensure that m+l is not greater than the last nozzle of the second inkjet pen $n_{i+1}$. If not, then the method 900 repeats 908, et seq., as has been described, to determine whether the adjustment performed results in alignment of the current rolling pair of pens.

However, if the verification fails, then the method 900 shifts the starting nozzles of the series of active nozzles of each of the pens $n_i$ and $n_{i+1}$ down by one nozzle (928), such that both series of active nozzles are shifted down, so that the series of active nozzles of the second pen $n_{i+1}$ is no longer shifted past its last nozzle. That is, the value k is decremented, as is the value m. Furthermore, because shifting the series of active nozzles of each of the pens $n_i$ and $n_{i+1}$ of the current rolling pair affects the series of active nozzles of any inkjet pens $n_0 \ldots n_{i-1}$ that have already been adjusted, the series of active nozzles of these pens are also shifted down one nozzle (930). The method 900 then repeats 908, et seq., as has been described.

If the type of misalignment between the bands output by the current rolling pair of inkjet pens does not result in overlap (922), then the value m is instead decremented (932), because the type of misalignment instead results in a gap between the bands. Decreasing m by one effectively shifts the active series of nozzles of the second inkjet pen $n_{i+1}$ down, towards the active series of nozzles of the first inkjet pen $n_i$. Verification is performed as to whether the series of active nozzles of the second inkjet pen $n_{i+1}$ was not shifted past, or before, the first nozzle of this pen (934). That is, verification is performed to ensure that m is not less than the first nozzle of the second inkjet pen $n_{i+1}$. If not, then the method 900 repeats 908, et seq., as has been described, to determine whether the adjustment performed results in alignment of the ink pens.

However, if the verification fails, then the method 900 shifts the starting nozzle of the series of active nozzles of the pens $n_i$ and $n_{i+1}$ up by one nozzle (936), such that both series of active nozzles are shifted up, so that the series of active nozzles of the second pen $n_{i+1}$ is no longer shifted before its first nozzle. That is, the value k is decremented, as is the value m. Furthermore, because shifting the series of active nozzles of each of the pens $n_i$ and $n_{i+1}$ of the current rolling pair affects the series of active nozzles of any inkjet pens $n_0 \ldots n_{i-1}$ that have already been adjusted, the series of active nozzles of these pens are also shifted up by one nozzle (938). The method 900 then repeats 908, et seq., as has been described.

As with the method 800, other embodiments to the method 900 can also be utilized. For instance, whereas the method 900 describes repeatedly selecting active nozzles, printing ink bands, and determining whether the bands are in alignment, until the bands are in alignment, in another embodiment a number of ink bands can be printed by each pen, using different nozzles of each pen. Determining which two of the ink bands of each adjacent pair of pens thus determines which of the nozzles of these pens should be used as the active series of nozzles so that they are aligned along the inkjet pen axis.

Correcting Misalignment of Inkjet Pens Along the Media Axis

Figure 10:
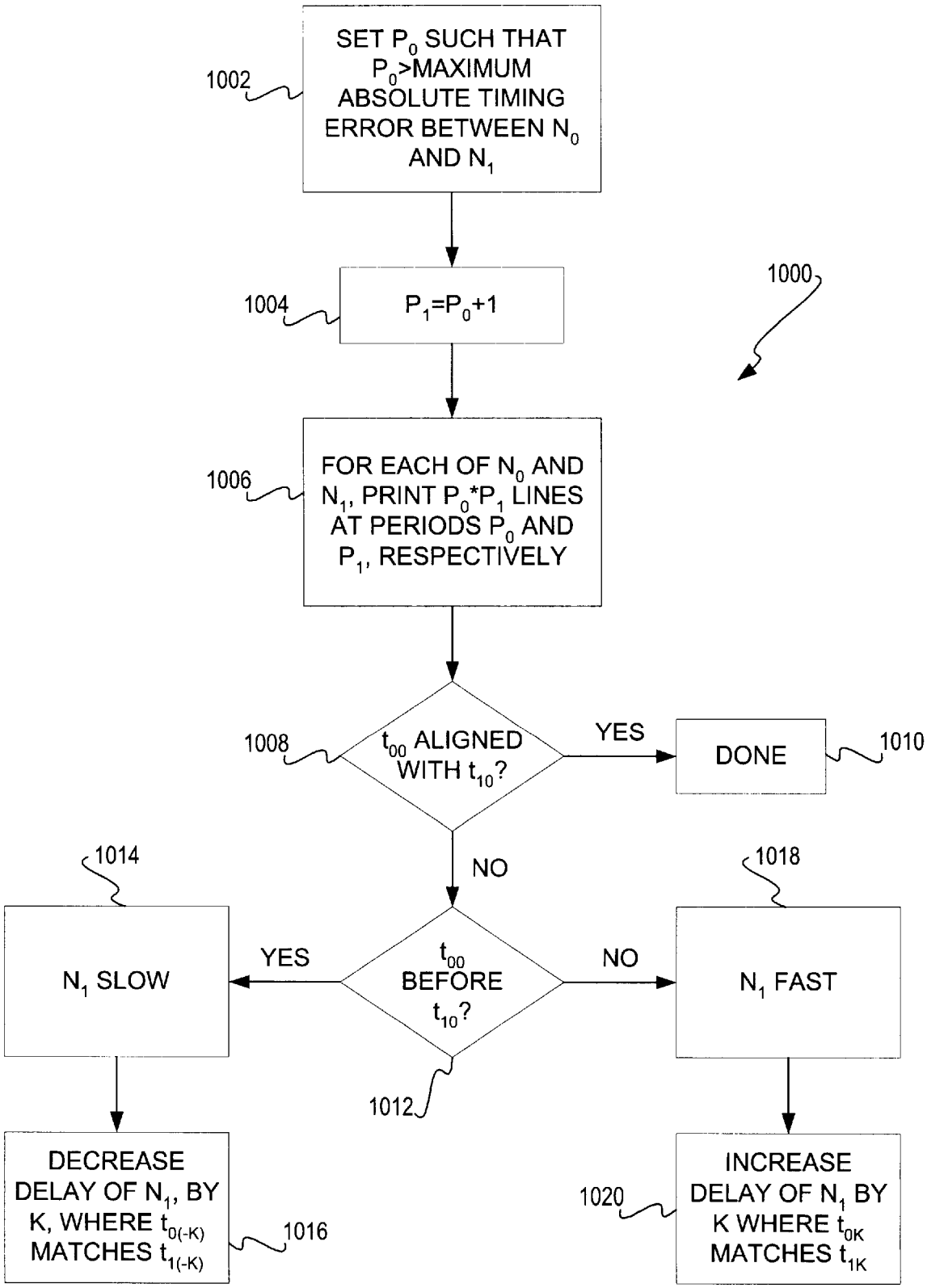
FIG. 10 is a flowchart of a method for correcting misalignment between a pair of inkjet pens along the media axis, according to an embodiment of the invention.

FIG. 10 shows a method 1000 for correcting the misalignment between a pair of inkjet pens along the media axis, according to an embodiment of the invention. Misalignment between pens along the media axis is generally defined herein as misalignment of the output of the pens along this axis, as can be appreciated by those of ordinary skill within the art. Furthermore, whereas the method 1000 is described in relation to inkjet pens that are stationary and staggered, it is generally applicable to pens that are stationary, regardless of whether they are staggered. The method 1000 adjusts the fluid ejection delay of a second inkjet pen $n_1$ so that it outputs a line along the media axis that is aligned with a line output along the media axis by a first inkjet pen $n_0$. The method 1000 accomplishes this by having the first inkjet pen $n_0$ print a number of lines along the media axis at a period $p_0$, and the second inkjet pen $n_1$ print a number of lines along the media axis at a period $p_1$ greater than $p_0$. The method 1000 adjusts the fluid ejection delay of the second inkjet pen $n_1$ based on which of the lines printed by the second inkjet pen $n_1$ is aligned with which of the lines printed by the first inkjet pen $n_0$.

First, the method 1000 sets $p_0$ such that it and/or the time delay to which the it corresponds is preferably, but not necessarily, greater than the maximum absolute timing error between the inkjet pens $n_0$ and $n_1$ (1002). $p_0$ more precisely specifies the interval in pixels at which one-pixel wide lines will be printed by the first inkjet pen $n_0$. Therefore, $p_0$ is greater than the distance corresponding to the maximum absolute timing error between the pens. That is, $p_0$ is greater than the distance the media moves, in pixels, within a length of time equal to the maximum absolute timing error between the pens. $p_1$ is correspondingly the interval in pixels at which one-pixel wide lines will be printed by the second inkjet pen $n_1$. $p_1$ is set equal to $p_0$ plus one (1004). A number of lines $p_0 * p_1$ are printed by each of the inkjet pens $n_0$ and $n_1$ (1006), with the first inkjet pen $n_0$ printing its lines at intervals of $p_0$ pixels, and the second inkjet pen $n_1$ printing its lines at intervals of $p_1$ pixels.

Figure 11:
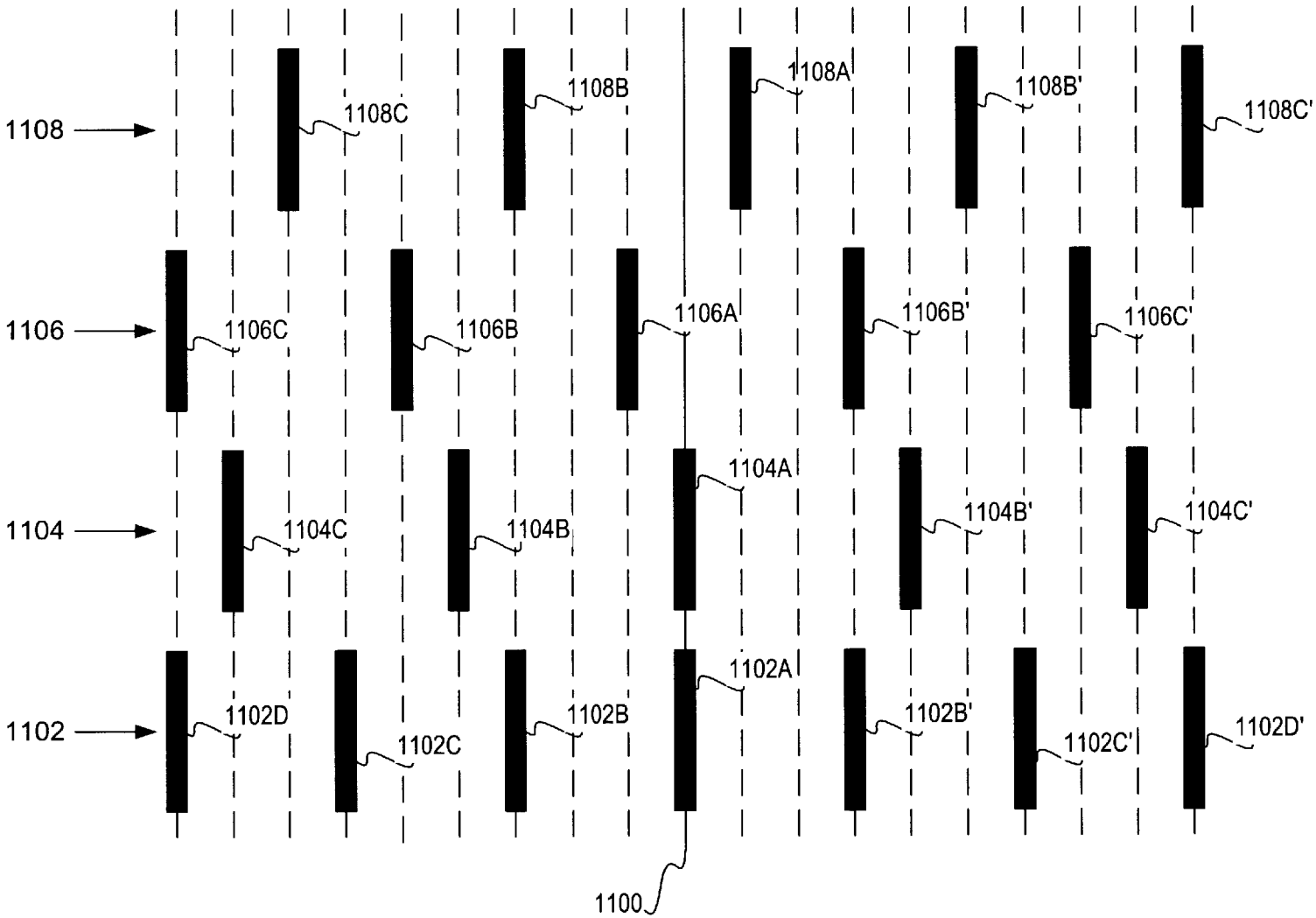
FIG. 11 is a diagram showing lines printed by a first inkjet pen at a first period, and lines printed by aligned or misaligned second inkjet pens at a second period greater than the first period, according to an embodiment of the invention.

FIG. 11 shows a rudimentary example of the lines printed by the first inkjet pen $n_0$, and three rudimentary examples of the lines printed by the second inkjet pen $n_1$, according to an embodiment of the invention. The lines printed by both inkjet pens have a nominal alignment line 1100, with respect to which alignment of the pens is analyzed. The first inkjet pen $n_0$ prints the lines 1102 at a period $p_0$ of three, such that at every third pixel-wide spacing, indicated by dotted lines in FIG. 11, there is one of the lines 1102. Seven such lines 1102 are shown in FIG. 11: the zeroth line 1102A at the alignment line 1100, the first lines 1102B and 1102B' printed to either side of the zeroth line 1102A, the second lines 1102C and 1102C' printed to either side of zeroth line 1102A, and the third lines 1102D and 1102D' printed to either side of the zeroth line 1102A. The lines 1102B, 1102C, and 1102D are left lines because they are to the left of the zeroth line 1102A, and the lines 1102B, 1102C, and 1102D are right lines because they are to the right of the zeroth line 1102A.

In the case where the second inkjet pen $n_1$ is aligned with the first inkjet pen $n_0$ along the media axis, the pen $n_1$ prints the lines 1104, at a period $p_1$ of four, such that at every fourth pixel-wide spacing, there is one of the lines 1104. Five such lines 1104 are shown in FIG. 11: the zeroth line 1104A at the alignment line 1100, the first lines 1104B and 1104B' printed to either side of the zeroth line 1104A, and the second lines 1104C and 1104C' printed to either side of the zeroth line 1104A. The first lines 1104B and 1104B' are referred to as the first lines, or the lines having the count number one, because they are the first lines to either side of the zeroth line 1104A. The second lines 1104C and 1104C' are likewise named. Furthermore, the lines 1104B and 1104C are left lines because they are to the left of the zeroth line 1104A, and the lines 1104B' and 1104C' are right lines because they are to the right of the zeroth line 1104A. Because the pens $n_0$ and $n_1$ are aligned, the first line printed by the pen $n_0$, the zeroth line 1102A, is aligned with the first line printed by the pen $n_1$, the zeroth line 1104A.

In the case where the second inkjet pen $n_1$ is misaligned with the first inkjet pen $n_0$ along the media axis, such that it prints its first line after (with respect to position) the first inkjet pen $n_0$ prints its first line, the pen $n_1$ prints the lines 1106, at a period $p_1$. Five such lines 1106 are shown in FIG. 11: the zeroth line 1106A which should be at the alignment line 1100, the first lines 1106B and 1106B' printed to either side of the zeroth line 1106A, and the second lines 1106C and 1106C' printed to either side of the zeroth line 1106A. The first lines 1106B and 1106B' are referred to as the first lines, or the lines having the number one, because they are the first lines to either side of the zeroth line 1106A. The second lines 1106C and 1106C' are likewise named. Furthermore, the lines 1106B and 1106C are left lines, because they are to the left of the zeroth line 1106A, whereas the lines 1106B' and 1106C' are right lines, because they are to the right of the zeroth line 1106A.

The zeroth line 1106A printed by the second inkjet pen $n_1$ is printed one pixel width after the zeroth line 1102A printed by the first inkjet pen $n_0$. The first line 1106B' is aligned with the first line 1102B'. To align the second inkjet pen $n_1$ with the first inkjet pen $n_0$, the fluid ejection delay of the pen $n_1$ is decreased by a length of time corresponding to one pixel width, so that the inkjet pen $n_1$ prints its first line sooner. That is, the delay of the pen $n_1$ is decreased by the length of time it takes for the media to move one pixel width. This delay is equal to the line number count—one—of the line to the right of the zeroth line printed by the second inkjet pen $n_1$ that is aligned with one of the lines to the right of the zeroth line printed by the first inkjet pen $n_0$.

In the case where the second inkjet $n_1$ is misaligned with the first inkjet pen $n_0$ along the media axis, such that it prints its first line before (with respect to position) the first inkjet pen $n_0$ prints its first line, the pen $n_1$ prints the lines 1108, at a period $p_1$. Four such lines 1108 are shown in FIG. 11: the zeroth line 1108A which should be at the alignment line 1100, the first lines 1108B and 1108B' printed to either side of the zeroth line 1108A, and the second lines 1108C and 1108C' printed to either side of the zeroth line 1108A. As before, the first lines 1108B and 1108B' are referred to as the first lines, or the lines having the number one, because they are the first lines to either side of the zeroth line 1108A. The second lines 1108C and 1108C' are likewise named. Furthermore, the lines 1108B and 1108C are left lines, because they are to the left of the zeroth line 1108A, and the lines 1108B' and 1108C' are right lines, because they are to the right of the zeroth line 1108A.

The zeroth line 1108A printed by the second inkjet pen $n_1$ is printed one pixel width before the zeroth line 1102A printed by the first inkjet pen $n_0$. The first line 1108B is aligned with the first line 1102B. To align the second inkjet pen $n_1$ with the first inkjet pen $n_0$, the fluid ejection delay of the pen $n_1$ is increased by a length of time corresponding to one pixel width, so that the inkjet pen $n_1$ prints its first line later. That is, the delay of the pen $n_1$ is increased by the length of time it takes for the media to move one pixel width. This delay is equal to the line number count—one—of the line to the left of the zeroth line printed by the second inkjet pen $n_1$ that is aligned with one of the lines to the left of the zeroth line printed by the first inkjet pen $n_0$.

Referring back to FIG. 10, the lines printed by the first inkjet pen $n_0$ and the second inkjet pen $n_1$ are referred to as $t_{0x}$ and $t_{1x}$, respectively. The method 1000 automatically or manually examines whether the first lines printed by the inkjet pens, $t_{00}$ and $t_{10}$, are aligned with one another (1008). For automatic alignment correction of the two inkjet pens, a sensor may determine whether these two lines are in alignment. For manual alignment correction, the user determines whether these two lines are in alignment. If the two lines $t_{00}$ and $t_{10}$ are in alignment with one another, then the method 1000 is finished (1010).

Otherwise, if the zeroth line printed by the first inkjet pen $n_0$, $t_{00}$, was printed before the zeroth line printed by the second inkjet pen $n_1$, $t_{10}$ (1012), then this means that the fluid ejection delay of the second inkjet pen $n_1$ is too slow—that is, the delay is too long (1014). The fluid ejection delay of the pen $n_1$ is decreased by the time corresponding to the number of pixels k (1016), where the line $t_{0(-k)}$ is a line printed by the first inkjet pen $n_0$ that is aligned with, or matches, a line printed by the second inkjet pen $n_1$, $t_{1(-k)}$. That is, the first kth line printed to the right of the zeroth line by the pen $n_1$ that matches the kth line printed to the right of the zeroth line by the pen $n_0$ is determined, such that the fluid ejection delay of the pen $n_1$ is decreased by the number of pixels k, where the periods of the lines printed by the inkjet pens differ by one pixel. Thus, the fluid ejection delay of the pen $n_1$ is decreased by the time that it takes for the media to move the number of pixels k.

More generally, if the periods of the lines printed by the inkjet pens differ by a number of pixels y >1, the fluid ejection delay of the pen $n_1$ is decreased by a number of pixels between ((k−1)*y) and k*y. For instance, where the periods of the lines printed by the inkjet pens differ by two pixels, and the first line printed to the right of the zeroth line by the pen $n_1$ matches the first line printed to the right of the zeroth line by the pen $n_0$, the fluid ejection delay of the pen $n_1$ is decreased by a number of pixels between zero or two. This is because the resolution of the fluid ejection delay mismatch between the two pens that can be detected, as it corresponds to a number of pixels, is no greater than the difference in pixels of the periods of the lines printed by the inkjet pens.

For example, in FIG. 11, the lines 1106 and the line 1102 represent the scenario in which the zeroth line is printed by the first inkjet pen $n_0$, the line 1102A, before the zeroth line is printed by the second inkjet pen $n_1$, the line 1106A. The line 1102B', the first line printed by the first inkjet pen $n_0$ to the right of the zeroth line 1102A, is referred to as $t_{0(-1)}$, and matches the first line printed by the second inkjet pen $n_1$ to the right of the zeroth line 1106A, which is the line 1106B' and which is referred to as $t_{1(-1)}$. Thus, k=1, and the fluid ejection delay of the pen $n_1$ is decreased by the time corresponding to one pixel. That is, the fluid ejection delay of the pen $n_1$ is decreased by the time it takes for the media to move one pixel.

Referring back to FIG. 10, if the zeroth line printed by the first inkjet pen $n_0$, $t_{00}$, was printed after the zeroth line printed by the second inkjet pen $n_1$, $t_{10}$ (1012), then this means that the fluid ejection delay of the second inkjet pen $n_1$ is too fast—that is, the delay is too short (1018). The fluid ejection delay of the pen $n_1$ is increased by the time corresponding to the number of pixels k (1020), where the line $t_{0k}$ is a line printed by the first inkjet pen $n_0$ that is aligned with, or matches, a line printed by the second inkjet pen $n_1$, $t_{1k}$. That is, the first kth line printed to the left of the zeroth line by the pen $n_1$ that matches the kth line printed to the left of the zeroth line by the pen $n_0$ is determined, such that the fluid ejection delay of the pen $n_1$ is increased by the number of pixels k, where the periods of the lines printed by the inkjet pens differ by one pixel. Thus, the fluid ejection delay of the pen $n_1$ is increased by the time that it takes for the media to move the number of pixels k.

More generally, if the periods of the lines printed by the inkjet pens differ by a number of pixels y >1, the fluid ejection delay of the pen $n_1$ is increased by a number of pixels between ((k−1)*y) and k*y. For instance, where the periods of the lines printed by the inkjet pens differ by two pixels, and the first line printed to the left of the zeroth line by the pen $n_1$ matches the first line printed to the left of the zeroth line by the pen $n_0$, the fluid ejection delay of the pen $n_1$ is increased by a number of pixels between zero or two. This is because the resolution of the fluid ejection delay mismatch between the two pens that can be detected, as it corresponds to a number of pixels, is no greater than the difference in pixels of the periods of the lines printed by the inkjet pens.

For example, in FIG. 11, the lines 1108 and the line 1102 represent the scenario in which the zeroth line is printed by the first inkjet pen $n_0$, the line 1102A, after the zeroth line is printed by the second inkjet pen $n_1$, the line 1108A. The line 1102B, the first line printed by the first inkjet pen $n_0$ to the left of the zeroth line 1102A, is referred to as $t_{01}$, and matches the first line printed by the second inkjet pen $n_1$ to the left of the zeroth line 1108A, which is the line 1108B' and which is referred to as $t_{11}$. Thus, k=1, and the fluid ejection delay of the pen $n_1$ is increased by the time corresponding to one pixel. That is, the fluid ejection delay of the pen $n_1$ is increased by the time it takes for the media to move one pixel.

Figure 12:
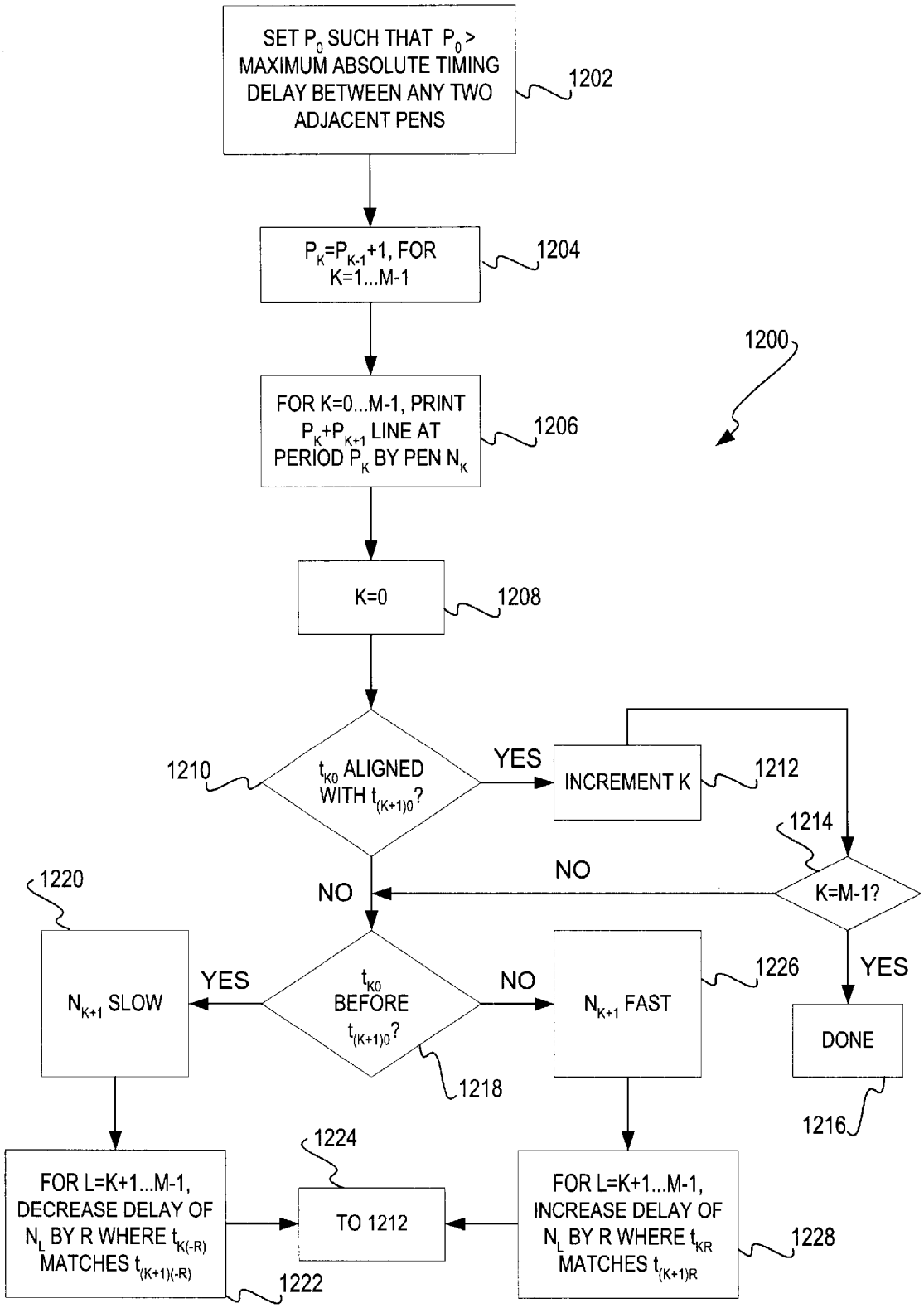
FIG. 12 is a flowchart of a method for correcting misalignment among a number of inkjet pens along the media axis, according to an embodiment of the invention.

The method 1000 of FIG. 10 can be extended to correct misalignment along the media axis between each successive rolling pair of inkjet pens of a number of inkjet pens. FIG. 12 shows such a method 1200 for correcting misalignment among a number of inkjet pens along the media axis, according to an embodiment of the invention. Whereas the method 1200 is described in relation to inkjet pens that are stationary and staggered, it is generally applicable to pens that are stationary, regardless of whether they are staggered. For each successive rolling pair of inkjet pens, the method 1200 adjusts the fluid ejection delay of the second inkjet pen of the pair so that it outputs a line along the media axis that is aligned with a line output along the media axis by the first inkjet pen of the pair.

First, the method 1200 sets $p_0$ such that it is greater than the maximum absolute timing error between any two adjacent inkjet pens (1202). As before, $p_0$ more precisely specifies the interval in pixels at which one-pixel wide lines will be printed by the first inkjet pen $n_0$. Therefore, $p_0$ is greater than the distance corresponding to the maximum absolute timing error between any two adjacent inkjet pens. Next, each $p_k$ is set to $(p_{k-1}+1)$, where k=1 . . . m−1, and where there are m total pens numbered 0 . . . m−1 (1204). Furthermore, for k=0 . . . m—1, each inkjet pen $n_k$ prints $p_k{}^*p_{k+1}$ lines at intervals of $p_k$ pixels (1206). The lines printed by the inkjet pen $n_k$ are referred to as $t_{kx}$, where x ranges from 0 . . . $[(p_k{}^*p_{(k+1)})-1]$.

In another embodiment of the invention, each inkjet pen that has two adjacent pens—an adjacent pen over the current pen and an adjacent pen below the current pen—prints a bottom set of lines and a top set of lines, at different intervals. The bottom set of lines is used to align the current pen with the adjacent pen below the current pen, and the top set of lines is used to align the current pen with the adjacent pen above the current pen. In this embodiment, the intervals $p_k$ do not have to be increased for each pen $n_k$ as has been indicated. Rather, it is sufficient for the intervals to alternate between sets of lines of the pens. For example, the bottom most pen may print lines at intervals y, and the top most pen may print lines at intervals y+1. Intervening pens then print two sets of lines, the bottom set at intervals y+1, and the top set at intervals y.

k is subsequently used as a counter, and set to zero (1208). The method 1200 then automatically or manually examines whether the first lines printed by the rolling pair of inkjet pens $n_k$ and $n_{k+1}$, $t_{k0}$ and $t_{(k+1)0}$, are aligned with one another (1210). If the two lines $t_{k0}$ and $t_{(k+1)0}$ match, then the method 1200 increments k to proceed with the next rolling pair of inkjet pens (1212). However, if k has been incremented to the last pen m−1 (1214), then there are no more rolling pairs of inkjet pens, and the method 1200 is finished (1216). Otherwise, the method 1200 repeats at 1210, et seq., as has been described, to determine whether the new rolling pair of inkjet pens is aligned with one another along the media axis.

However, if the zeroth line printed by the first inkjet pen $n_k$ of the current rolling pair, $t_{k0}$, was printed before the zeroth line printed by the second inkjet pen $n_{k+1}$ of the current rolling pair, $t_{(k+1)0}$ (1218), then this means that the fluid ejection delay of the second inkjet pen $n_{k+1}$ is too slow—that is, the delay is too long (1220). Therefore, the fluid ejection delay of the pen $n_{k+1}$, and the fluid ejection delays of all the inkjet pens subsequent to this pen, are decreased by the time corresponding to the number of pixels r (1222), where the line $t_{k(-r)}$ is the first line printed by the first inkjet pen $n_k$ to the right of the zeroth line that is aligned with, or matches, a line printed by the second inkjet pen $n_{k+1}$, $t_{(k+1)(-r)}$, to the right of the zeroth line. That is, the fluid ejection delay of each pen $n_l$, where l=k+1 . . . m−1, is decreased by the time it takes for the media to move the number of pixels r. The method then proceeds to 1212 (1224), as has been described.

Conversely, if the zeroth line printed by the first inkjet pen $n_k$ of the current rolling pair, $t_{k0}$, was printed after the zeroth line printed by the second inkjet pen $n_{k+1}$ of the current rolling pair, $t_{(k+1)0}$ (1218), then this means that the fluid ejection delay of the second inkjet pen $n_{k+1}$ is too fast—that is, the delay is too short (1226). Therefore, the fluid ejection delay of the pen $n_{k+1}$, and the fluid ejection delays of all the inkjet pens subsequent to this pen, are increased by the time corresponding to the number of pixels r (1228), where the line $t_{kr}$ is a line printed by the first inkjet pen $n_k$ to the left of the zeroth line that is aligned with, or matches, a line printed by the second inkjet pen $n_{k+1}$, $t_{(k+1)r}$, to the left of the zeroth line. That is, the fluid ejection delay of each pen $n_l$, where l=k+1 . . . m−1, is decreased by the time it takes for the media to move the number of pixels r. The method then proceeds to 1212 (1224), as has been described.

Conclusion

Figure 13:
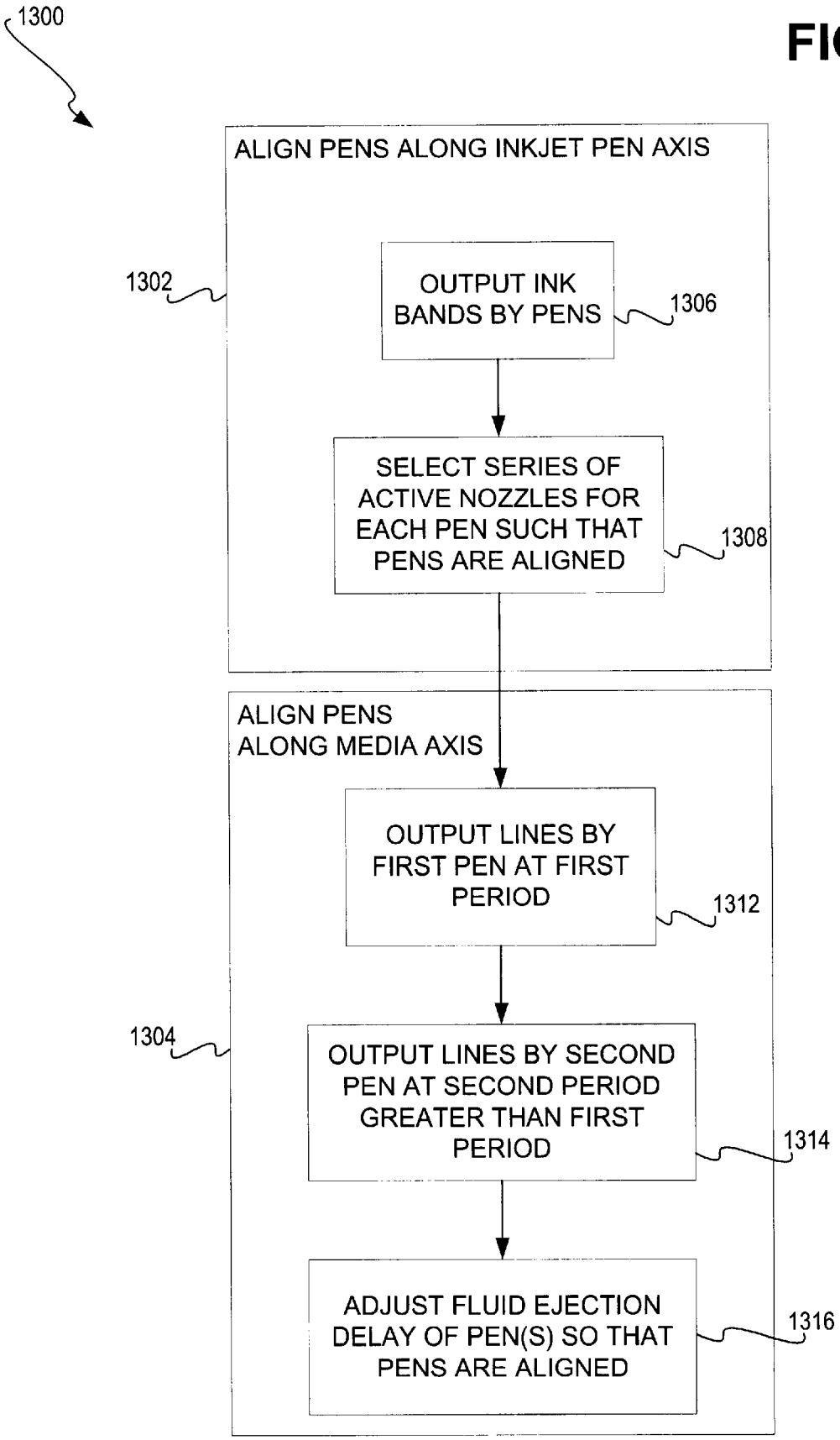
FIG. 13 is a flowchart of a method according to an embodiment of the invention.

FIG. 13 shows a method 1300 that summarizes the stationary staggered inkjet pen alignment over the inkjet pen axis and the media axis that has been described, according to an embodiment of the invention. The method 1300 first aligns a pair of stationary staggered inkjet pens over the inkjet pen axis (1302). The method 1300 then aligns the pair of stationary staggered inkjet pens over the media axis (1304).

To align the pair of pens along the inkjet pen axis, ink bands are printed by both pens (1306). The series of nozzles that output aligned ink bands are selected as the active series of nozzles for the inkjet pens, such that the pens are aligned (1308). To align the pair of pens along the media axis, the first pen of the pair outputs lines along the media axis at a first period (1312). The second pen of the pair outputs lines along the media at a second period greater than the first period (1314). The fluid ejection delay of either or both of the inkjet pens is then adjusted, based on which of the lines output by the second pen is aligned with, or matches, which of the lines output by the first pen (1316).

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. For example, whereas an embodiment of the invention is partially described in relation to an inkjet printer dispensing ink, it is more broadly applicable to other kinds of fluid ejection systems. Therefore, it is manifestly intended that this invention be limited only by the claims and equivalents thereof.

I claim:

1. A method for reducing misalignment of a pair of stationary fluid ejector assemblies positioned along a first axis perpendicular to a second axis along which media moves past the assemblies, the method reducing misalignment of the pair of stationary fluid ejector assemblies along the second axis, the method comprising:

outputting first fluid lines at a first period by one of the assemblies;

outputting second fluid lines at a second period greater than the first period by another of the assemblies; and, adjusting a fluid ejection delay of at least one of the assemblies based on which of the second fluid lines is substantially aligned with which of the first fluid lines along the second axis.

2. The method of claim 1, wherein adjusting the fluid ejection delay of at least one of the assemblies comprises:

in response to determining that a first of the first fluid lines is output before a first of the second fluid lines, decreasing the fluid ejection delay of the other of the assemblies commensurate with which of the second fluid lines is substantially aligned with which of the first fluid lines along the second axis; and, in response to determining that the first of the first fluid lines is output after the first of the second fluid lines, increasing the fluid ejection delay of the other of the assemblies commensurate with which of the second fluid lines is substantially aligned with which of the first fluid lines along the second axis.

3. The method of claim 2, wherein decreasing the fluid ejection delay of the other of the assemblies comprises decreasing the fluid ejection delay of the other of the assemblies commensurate with a number of pixels equal to a count number of the first fluid line substantially aligned with the second fluid line along the second axis.

4. The method of claim 2, wherein increasing the fluid ejection delay of the other of the assemblies comprises increasing the fluid ejection delay of the other of the assemblies commensurate with a number of pixels equal to a count number of the second fluid line substantially aligned with the first fluid line along the second axis.

5. The method of claim 1, wherein outputting the first fluid lines comprises outputting one-pixel wide fluid lines by the series of active nozzles of the one of the assemblies at the first period greater than a maximum absolute timing error between the one of the assemblies and the other of the assemblies and corresponding to a plurality of pixels-in-width spacing between the one-pixel wide fluid lines.

6. The method of claim 1, wherein outputting the second fluid lines comprises outputting one-pixel wide fluid lines by the series of active nozzles of the other of the assemblies at the second period greater than the first period and corresponding to a plurality of pixels-in-width spacing between the one-pixel wide fluid lines.

7. A computer-readable medium having a computer program stored thereon to perform a method for aligning a plurality of stationary fluid ejector assemblies positioned along a first axis perpendicular to a second axis along which media moves past the assemblies, the method aligning the plurality of stationary fluid ejector assemblies along the second axis, the method comprising:

outputting fluid lines along the first axis by the plurality of assemblies, each assembly outputting the fluid lines along the first axis at a period different than that of any adjacent assemblies;

for each successively rolling pair of assemblies within the plurality of assemblies, including a first assembly of the pair, outputting first fluid lines and a second assembly of the pair outputting second fluid lines, in response to determining that a first of the first fluid lines is output in position before a first of the second fluid lines is output, decreasing a fluid ejection delay of the second assembly, and fluid ejection delays of any other assemblies succeeding the second assembly within the plurality of assemblies, commensurate with which of the second fluid lines is aligned with which of the first fluid lines along the second axis;

in response to determining that the first of the first fluid lines is output in position after the first of the second fluid lines, increasing the fluid ejection delay of the second assembly, and the fluid ejection delays of any other assemblies succeeding the second assembly within the plurality of assemblies, commensurate with which of the second fluid lines is aligned with which of the first fluid lines along the second axis.

8. The medium of claim 7, wherein outputting the fluid lines comprises outputting one-pixel wide fluid lines by a first assembly of the plurality of assemblies at a period greater than a maximum absolute timing error between any two successive assemblies of the plurality of assemblies.

9. The medium of claim 7, wherein outputting the fluid lines comprises outputting one-pixel wide fluid lines by the plurality of assemblies at periods corresponding to between fluid line spacings successively increasing by one pixel between successive assemblies of the plurality of assemblies.

10. The medium of claim 7, wherein decreasing the fluid ejection delay of the second assembly, and the fluid ejection delays of any other assemblies succeeding the second assembly, comprises decreasing the fluid ejection delay of the second assembly, and the fluid ejection delays of any other assemblies succeeding the second assembly, commensurate with a number of pixels equal to a count number of the first fluid line aligned with the second fluid line along the second axis.

11. The medium of claim 7, wherein increasing the fluid ejection delay of the second assembly, and the fluid ejection delays of any other assemblies succeeding the second assembly, comprises increasing the fluid ejection delay of the second assembly, and the fluid ejection delays of any other assemblies succeeding the second assembly, commensurate with a number of pixels equal to a count number of the second fluid line aligned with the first fluid line along the second axis.

12. A fluid ejection system comprising:

a plurality of stationary fluid ejector assemblies positioned along a first axis perpendicular to a second axis along which media is moved past the assemblies; and, a fluid ejector assembly alignment component to align the assemblies along the second axis by causing the assemblies to output fluid lines at different periods and adjusting fluid ejection delays of the assemblies based on which of the fluid lines output by different of the assemblies are aligned with one another along the second axis.

13. The system of claim 12, further comprising a sensor to detect fluid output on the media, such that the component interacts with the sensor to automatically align the assemblies along the second axis.

14. The system of claim 12, further comprising a display mechanism and a user input mechanism, such that a user interacts with the component via the display mechanism and the user input mechanism to manually align the assemblies along the second axis.

15. The system of claim 12, wherein the plurality of stationary fluid ejector assemblies comprises a plurality of stationary staggered fluid ejector assemblies.

16. The system of claim 12, wherein the system is an inkjet printer, the fluid ejector assemblies comprise inkjet pens, the fluid bands comprise ink bands, and the fluid lines comprise ink lines.

17. A fluid ejection system comprising:

a plurality of stationary fluid ejector assemblies positioned along a first axis perpendicular to a second axis along which media is moved past the assemblies; and, means for aligning the assemblies along the second axis by causing the assemblies to output fluid lines at different periods and adjusting fluid ejection delays of the assemblies based on which of the fluid lines output by different of the assemblies are aligned with one another along the second axis.

18. The system of claim 17, further comprising means for aligning the assemblies along the first axis by repeatedly differently selecting series of active nozzles of the assemblies and causing the series of active nozzles of the assemblies to output fluid bands until the fluid bands are aligned along the first axis.

19. The system of claim 17, wherein the plurality of stationary fluid ejector assemblies comprises a plurality of stationary staggered fluid ejector assemblies.

20. The system of claim 17, wherein the system is an inkjet printer, the fluid ejector assemblies comprises inkjet pens, and the fluid lines comprising ink lines.

* * * * *